US006830093B2

(12) United States Patent
Bramley

(10) Patent No.: US 6,830,093 B2
(45) Date of Patent: Dec. 14, 2004

(54) POSITIONING TOOL FOR CERAMIC CORES

(75) Inventor: John Bramley, Escondido, CA (US)

(73) Assignee: Callaway Golf Company, Carlsbad, CA (US)

( * ) Notice: Subject to any disclaimer, the term of this patent is extended or adjusted under 35 U.S.C. 154(b) by 134 days.

(21) Appl. No.: 10/065,987

(22) Filed: Dec. 6, 2002

(65) Prior Publication Data

US 2003/0116300 A1 Jun. 26, 2003

Related U.S. Application Data

(60) Provisional application No. 60/343,866, filed on Dec. 26, 2001.

(51) Int. Cl.[7] ..... B22C 9/04; B22C 9/10

(52) U.S. Cl. ..... 164/34; 164/45; 164/516

(58) Field of Search ..... 164/34, 35, 516

(56) References Cited

U.S. PATENT DOCUMENTS

| | | | | |
|---|---|---|---|---|
| 2,948,031 A | | 8/1960 | Webb | |
| 3,172,667 A | | 3/1965 | Baker et al. | |
| 3,468,544 A | | 9/1969 | Antonious | |
| 3,794,328 A | | 2/1974 | Gordon | |
| 3,849,053 A | | 11/1974 | Bruce et al. | |
| 3,856,256 A | | 12/1974 | Celesti | |
| 3,941,390 A | | 3/1976 | Hussey | |
| 3,974,997 A | | 8/1976 | Bolton | |
| 4,326,326 A | * | 4/1982 | MacDonald | 29/428 |
| 4,383,819 A | | 5/1983 | Letica | |
| 4,420,447 A | | 12/1983 | Nakashima | |
| 4,429,879 A | | 2/1984 | Schmidt | |
| 4,432,549 A | | 2/1984 | Zebelean | |
| 4,472,092 A | | 9/1984 | Schmidt | |
| 4,575,447 A | | 3/1986 | Hariguchi | |
| 4,630,825 A | | 12/1986 | Schmidt | |
| 4,650,626 A | | 3/1987 | Kurokawa | |
| 4,681,321 A | | 7/1987 | Chen | |
| 4,731,014 A | | 3/1988 | Von Holdt | |
| 4,765,585 A | | 8/1988 | Wieder | |
| 4,768,747 A | | 9/1988 | Williams et al. | |
| 4,811,778 A | | 3/1989 | Allen et al. | |
| 4,832,307 A | | 5/1989 | Watanabe et al. | |
| 4,842,243 A | | 6/1989 | Butler | |
| 4,880,047 A | | 11/1989 | VanRens | |
| 4,883,623 A | | 11/1989 | Nagamoto et al. | |
| 4,993,475 A | | 2/1991 | Yamada | |

(List continued on next page.)

FOREIGN PATENT DOCUMENTS

EP 377 673 B1 7/1988

OTHER PUBLICATIONS

McGill, David J. and King, Wilton, W., Engineering Mechanics, Statics, 3rd Ed., 1995.

(List continued on next page.)

*Primary Examiner*—Kiley S. Stoner
*Assistant Examiner*—Len Tan
(74) *Attorney, Agent, or Firm*—Michael A. Catania; Elaine H. Lo

(57) ABSTRACT

An apparatus and method for forming a hollow golf club head is disclosed. The apparatus includes a first mold cavity having depressions formed therein, a second mold cavity having a shape complementary to the exterior of the desired club head, a ceramic core, and wax injecting means. Each depression of the first mold cavity has a depth equal to a desired wall thickness of a corresponding portion of the club head. When the ceramic core is placed in the first mold cavity and wax is injected, wax protuberances, which correspond to the depressions, are formed about the ceramic core. The wax protuberances position the ceramic core in the second mold cavity, where wax is deposited over the majority of the ceramic core.

5 Claims, 5 Drawing Sheets

U.S. PATENT DOCUMENTS

| | | | | |
|---|---|---|---|---|
| 5,054,784 | A | | 10/1991 | Collins |
| 5,204,046 | A | | 4/1993 | Schmidt |
| 5,219,408 | A | | 6/1993 | Sun |
| 5,261,478 | A | | 11/1993 | Sun |
| 5,296,308 | A | | 3/1994 | Caccavale et al. |
| 5,346,218 | A | * | 9/1994 | Wyte ..... 473/346 |
| 5,366,222 | A | | 11/1994 | Lee |
| 5,377,985 | A | | 1/1995 | Ohnishi |
| 5,398,746 | A | * | 3/1995 | Igarashi ..... 164/98 |
| 5,485,998 | A | | 1/1996 | Kobayashi |
| 5,524,698 | A | | 6/1996 | Chen et al. |
| 5,547,360 | A | | 8/1996 | Yokoyama |
| 5,577,550 | A | * | 11/1996 | Schmidt ..... 164/516 |
| 5,628,698 | A | | 5/1997 | Sumitomo |
| 5,971,867 | A | | 10/1999 | Galy |
| 6,010,411 | A | | 1/2000 | Reyes |
| 6,102,813 | A | | 8/2000 | Dill |
| 6,123,627 | A | | 9/2000 | Antonious |
| 6,244,976 | B1 | | 6/2001 | Murphy |
| 6,248,025 | B1 | | 6/2001 | Murphy |
| 6,364,788 | B1 | | 4/2002 | Helmstetter |

OTHER PUBLICATIONS

Meirovitch, Leonard, Methods of Analytical Dynamics, 1970.

Kane, Thomas R. and Levinson, David A., Dynamics, Theory and Applications 1985.

Greenwood, Donald T., Principles of Dynamics, 1965.

Shames, Irvine H., Engineering Mechanics, 4th. Ed., 1996.

Griffiths, J.B., The Theory of Classical Dynamics, 1965,.

Experimental determination of inertia ellipsoids, Johnson, S.H., Lehigh University, Bethlehem, PA 1994.

Determining the central principal inertia dyadic of a golf head. Twigg, M.J., and Butler, J.H. Experimental Techniques, Sep./Oct. 1996.

* cited by examiner

POSITIONING TOOL FOR CERAMIC CORES

CROSS REFERENCE TO RELATED APPLICATIONS

This application is a continuation-in-part of U.S. Patent Application No. 60/343,866, filed on Dec. 26, 2001.

FEDERAL RESEARCH STATEMENT

[Not Applicable]

BACKGROUND OF INVENTION

1. Field of the Invention

The present invention relates to investment cast molding tools for the manufacture of golf club heads. More specifically, the present invention relates to an investment cast molding tool for one-piece construction of hollow metal wood-type golf club heads.

2. Description of the Related Art

One of the oldest methods of forming golf club heads is through investment casting. This process is currently used to produce the majority of wood-type golf club heads. In this process, a resin mold, which includes two plates composed of aluminum hinged at one end and having a hollow center, is used. A master copy of the golf club head to be produced is suspended in the hollow center and a liquid resin is poured around the master copy to create the outer shape of the golf club head upon solidification of the resin.

In hollow metal wood-type golf club heads, the interior shape of the golf club head is produced by an aluminum core, which typically consists of five pieces. Wax is injected into the mold to fill the space between the inner and outer shapes of the golf club head. The mold is opened and the aluminum core with the wax around it is removed. The aluminum core is separated from the wax by first removing a center piece of the core. The remaining pieces of the core are then removed through the opening that was created by removal of the center core piece. When all of the pieces of the core are removed, the golf club head will have a large opening in either the crown or sole, through which the aluminum core was removed. This opening is then covered by a plate, which is typically welded about its perimeter to the golf club head. The weld must then be sanded smooth to blend with the rest of the golf club head. This sometimes leads to walls that either are too thin or have unexpected variations in thickness. Additionally, sometimes slag or pieces of the weld will fall into the hollow interior of the golf club head leading to unwanted rattling in the club head.

Thus, there is a need for an improved apparatus and method for forming hollow golf club heads. The preferred apparatus and method eliminate the use of multi-piece aluminum cores, which require a large opening in either the crown or sole of the-golf club head.

SUMMARY OF INVENTION

The present invention is a replacement to the use of molds with multi-piece aluminum cores. In accordance with the present invention, an apparatus includes a first mold, a second mold, a ceramic core, and means for injecting wax. The first mold has a cavity with a plurality of depressions formed therein. Each of the depressions has a depth substantially equal to the wall thickness of a corresponding portion of the desired golf club head. When the ceramic core, which has an exterior surface that corresponds to an interior of the golf club head, is inserted into the first mold cavity and wax is injected, wax protuberances corresponding to the depressions are formed about the exterior surface of the ceramic core. The ceramic core with the wax protuberances is then removed from the first mold and placed in the second mold. The second mold has a cavity that is complementary in shape to the exterior of the desired golf club head. The wax protuberances properly situate the ceramic core completely within the second mold cavity to ensure that the walls of the resulting golf club head have the correct thicknesses. Wax is then injected into the second mold cavity. The wax adheres to the wax protuberances and to a majority of the exterior surface of the ceramic core. The wax-covered ceramic core is then removed from the second mold. A shell is formed over the wax, and the wax is melted, leaving a gap between the shell and the ceramic core. Molten metal is then cast into the gap to form the golf club head. After metal has cooled, ultrasonic vibration may be used to break up the ceramic core and remove it from the interior of the golf club head.

Having briefly described the present invention, the above and further objects, features and advantages thereof will be recognized by those skilled in the pertinent art from the following detailed description of the invention when taken in conjunction with the accompanying drawings.

DETAILED DESCRIPTION

The present invention includes an apparatus and method for forming a golf club head, and more particularly a hollow, metallic wood-type golf club head. By employing a two-step molding process to deposit wax about a ceramic core, the apparatus and method in accordance with the present invention eliminate the need for multi-piece aluminum cores.

Figure 1:
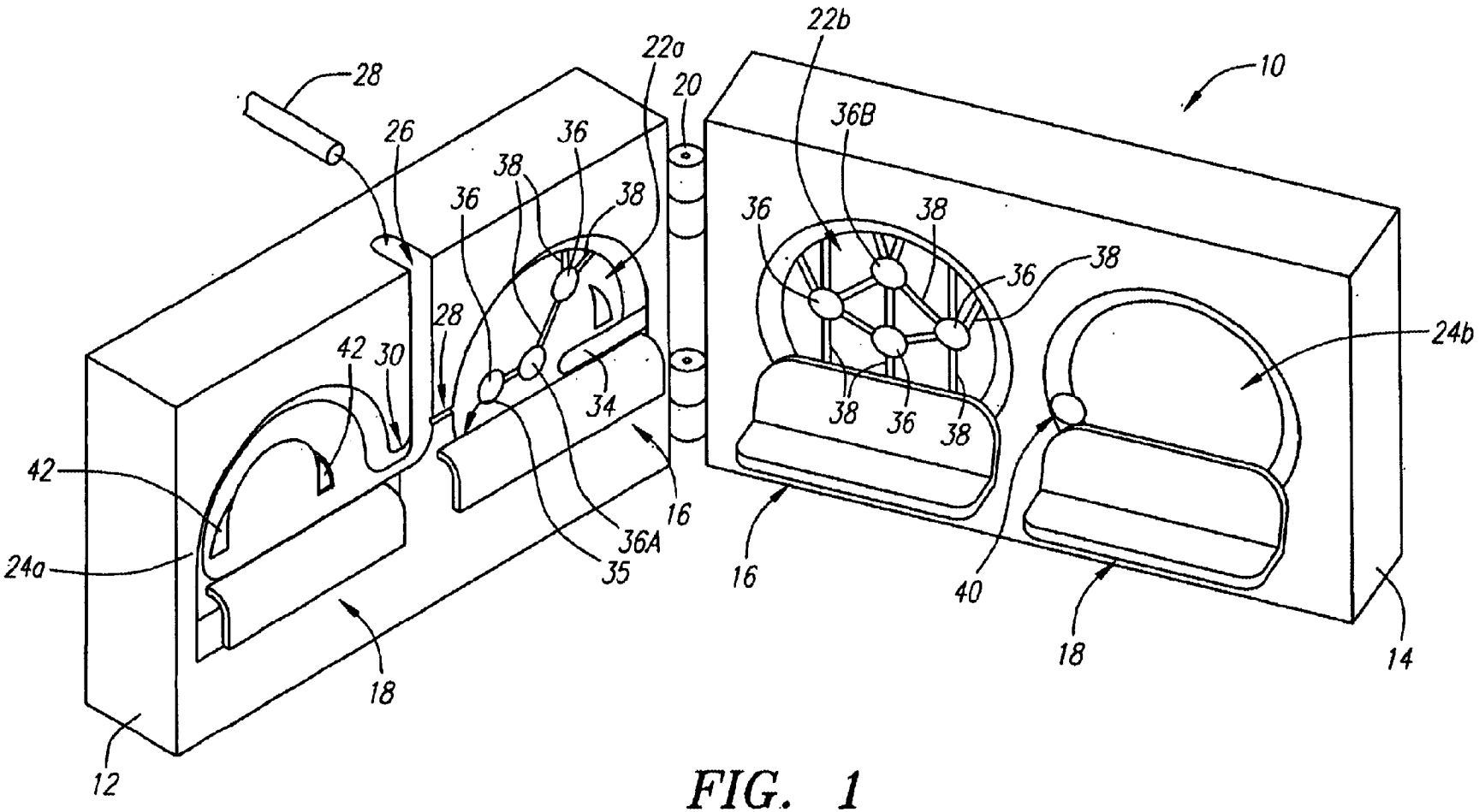
FIG. 1 is a perspective view of a first mold and a second mold in accordance with the present invention.
Figure 2:
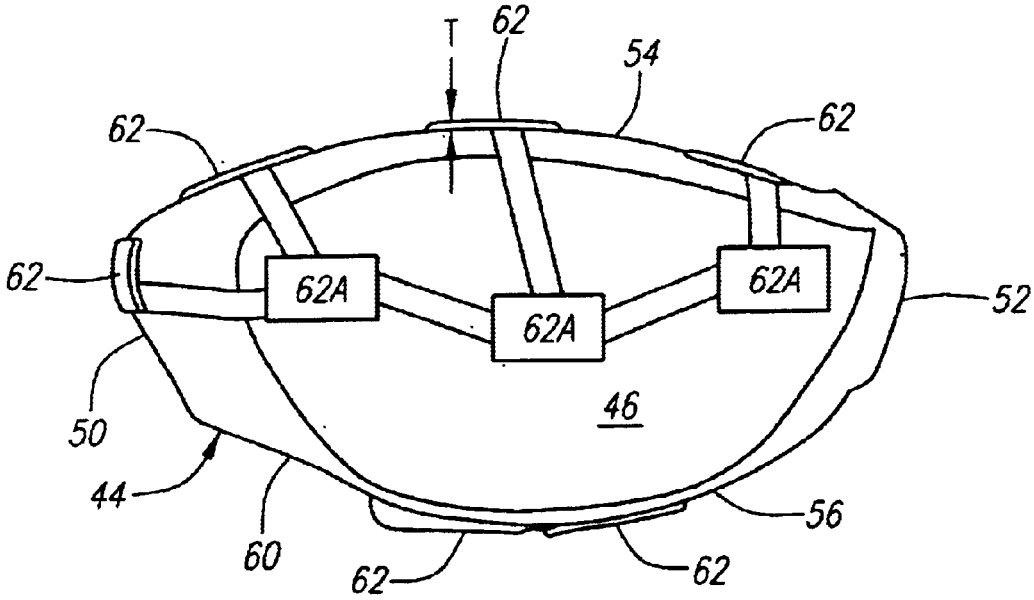
FIG. 2 is a front perspective view of a ceramic core with wax protuberances formed about the exterior surface of the core in accordance with the present invention.
Figure 3:
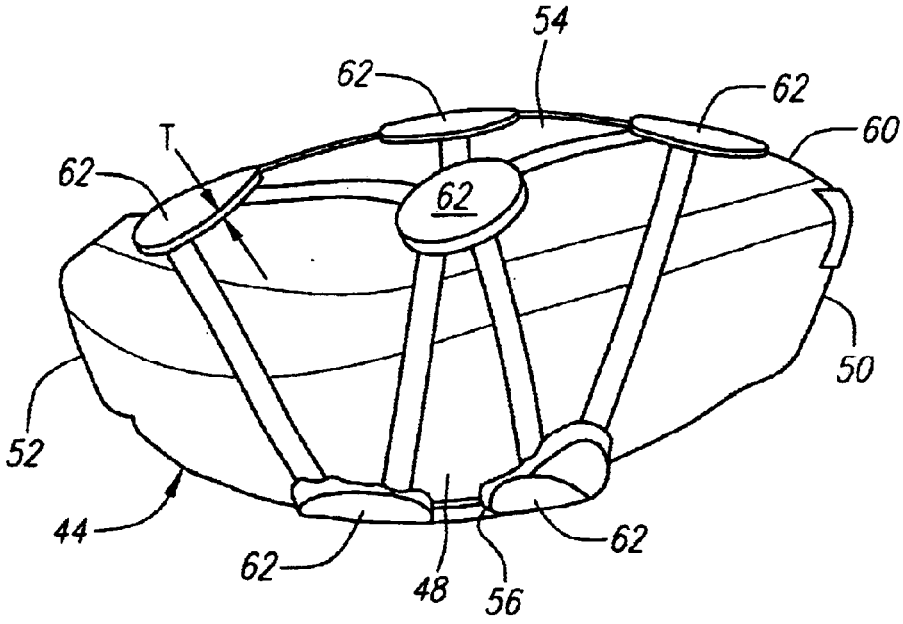
FIG. 3 is a back perspective view of the ceramic core of FIG. 2.
Figure 4:
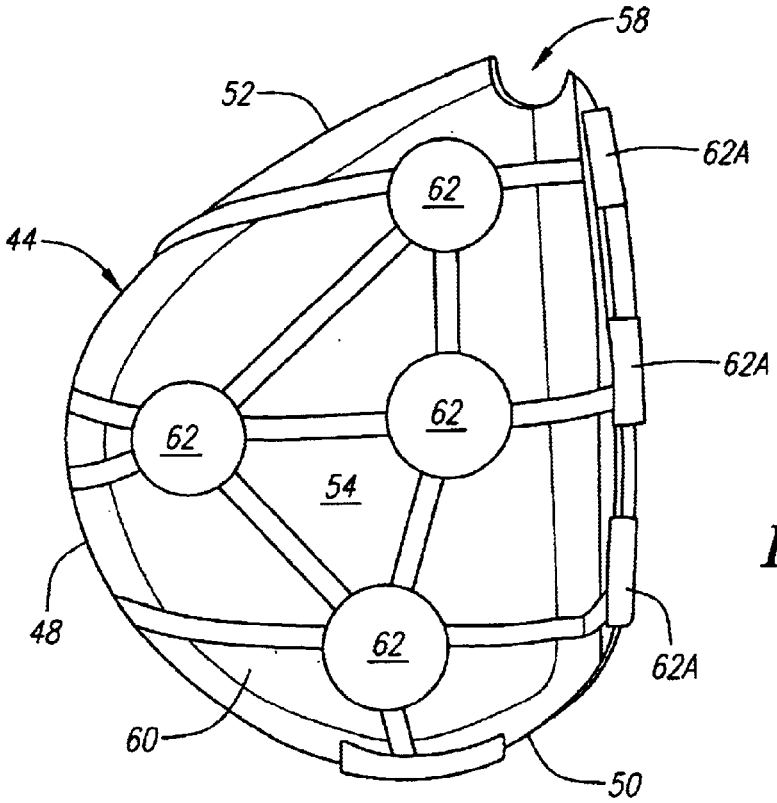
FIG. 4 is a top plan view of the ceramic core of FIG. 2.
Figure 5:
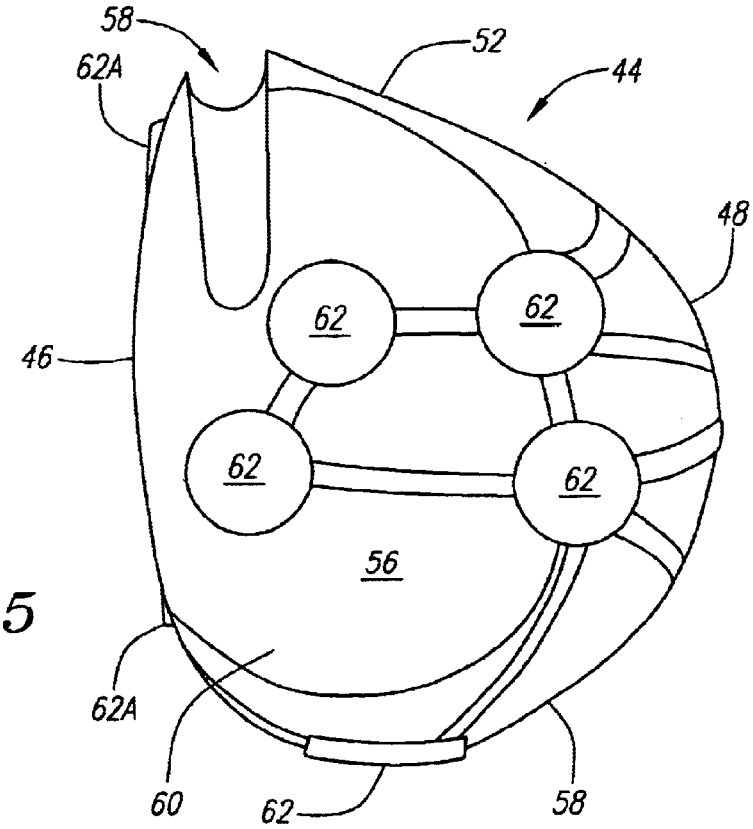
FIG. 5 is a bottom plan view of the ceramic core of FIG. 2.

FIG. 1 illustrates an apparatus 10 for forming a golf club head in accordance with the present invention. Apparatus 10 includes a first half 12 and a second half 14, which together make up a first mold 16 and a second mold 18. First and second halves 12 and 14 of apparatus 10 are coupled together by a hinge 20. First mold 16 has a cavity 22, a portion 22*a* of which is formed in first half 12 of apparatus 10, and another portion 22*b* of which is formed in second half 14 of apparatus 10. When the two halves 12 and 14 of apparatus 10 are brought together in a closed position, portions 22*a* and 22*b* register together to form a single, complete first mold cavity 22. Similarly, second mold 18 has a cavity 24, a portion 24*a* of which is formed in first half 12 of apparatus 10, and another portion 24*b* of which is formed in second half 14 of apparatus 10. Portions 24*a* and 24*b* unite to complete cavity 24, when first and second halves 12 and 14 are brought together in the closed position. Although FIG. 1 illustrates first mold 12 and second mold 14 as being integrally formed in apparatus 10, one of ordinary skill in the art will appreciate that the two molds may be separate, with each having its own first and second halves connected together by a hinge.

Apparatus 10 further includes a supply duct 26 for directing injected wax from a source 28 to first mold 16 and second mold 18. A branch duct 30 extends from supply duct 26 into first mold cavity 22, while a branch duct 32 extends from supply duct 26 into second mold cavity 24.

First mold cavity 22 has a shape generally complementary to the interior of a desired golf club head, with cavity portion 22*a* forming the lower portion of the golf club head interior, and cavity portion 22*b* forming the top portion. First mold cavity portion 22*a* includes an elongated portion 34 that projects into cavity 22 to create an opening in the resulting golf club head for a shaft. First mold cavity portion 22*a* further includes an interior wall 35 for forming the back of the front face of the golf club head.

A plurality of depressions 36 and channels 38 are formed in each of the mold cavity portions 22*a* and 22*b*. Channels 38 interconnect depressions 36 to ensure that wax from supply duct 26 reaches all of the depressions 36. Depressions 36 are illustrated as being circular in shape One of ordinary skill in the art, however, will appreciate that depressions 36 may have any appropriate shape, including triangular, rectangular, and other regular or irregular polygonal shapes.

Each depression 36 has a depth that is equal to the thickness of a respective wall of the desired golf club head. Thus, for example, a depression 36A in cavity portion 22*a* has a depth equal to the thickness of the sole of the desired golf club head at that location. Similarly, a depression 36B in cavity portion 22*b* has a depth equal to the thickness of the crown of the desired golf club head at that location. The depths of depressions 36 may range from 0.002 inch to 0.350 inch, preferably from 0.035 inch to 0.150 inch, and more preferably from 0.040 inch to 0.100 inch. Additional depressions (not shown) are formed in interior wall 35 and have a depth equal to the thickness of the front face of the golf club head.

First mold cavity 22 is designed to receive a ceramic core 44 (FIGS. 2-5). Ceramic core 44 is identical in size and shape to the interior of the desired golf club head. As illustrated in FIGS. 2-5, ceramic core 44 has a front face portion 46, a rear portion 48, a toe portion 50, a heel portion 52, a crown portion 54, and a sole portion 56. Ceramic core 44 further includes an opening 58 in heel portion 52 for a golf club shaft. When ceramic core 44 is placed in first mold cavity 22, the walls of first mold cavity 22 contact an exterior surface 60 of ceramic core 44 except at the locations of depressions 36 and channels 38. As a result, wax injected into first mold cavity 22 will accumulate only in depressions 36 and channels 38, thereby forming interconnected wax protuberances 62 on the exterior surface 60 of ceramic core, as shown in FIGS. 2-5. The pressure at which the wax is injected into first mold cavity 22, typically. around 200 psi, causes the wax to adhere to ceramic core 44. Protuberances 62 correspond to depressions 36 in first mold cavity 22, and therefore have a thickness T equal to that of a respective wall of the desired golf club head. Protuberances 62A on front face 46 of ceramic core 44 have a rectangular shape, while the remainder of protuberances 62 are circular. Protuberances 62, however, may have any appropriate shape.

Referring back to FIG. 1, second mold cavity 24 has a shape generally complementary to the exterior of the desired golf club head, with cavity portion 24*a* forming the lower portion of the golf club head exterior, and cavity portion 24*b* forming the crown. An opening 40, which corresponds to the location of the golf club shaft, is provided in cavity portion 24*b*.

Second mold cavity 24 further includes two projections 42 extending into the cavity by an amount equal to the thickness of that portion of the golf club wall. In FIG. 1, projections 42 are shown as being located on the sole of the golf club head, however, projections 42 may be placed at other appropriate locations of the club head, such as along the rear wall of the club head. In addition, a single projection or more than two projections may be used. Projections 42 ensure that wax will not cover a portion of ceramic core 44, so that ceramic core 44 may be removed from the golf club head.

After ceramic core 44 has been inserted into first mold cavity 22 and wax protuberances 62 formed on exterior surface 60, ceramic core 44 is inserted into second mold cavity 24. Since ceramic core will be fully encased in second mold cavity 24 when second mold 18 is closed, wax protuberances 62 properly center ceramic core 44 within second mold cavity 24 and ensure that the wall thicknesses of the resulting golf club head are correct. Wax is then injected into second mold cavity 24. The wax adheres to the remaining exposed portions of exterior surface 60 ceramic. core 44 and to the previously formed protuberances 62.

Figure 6:
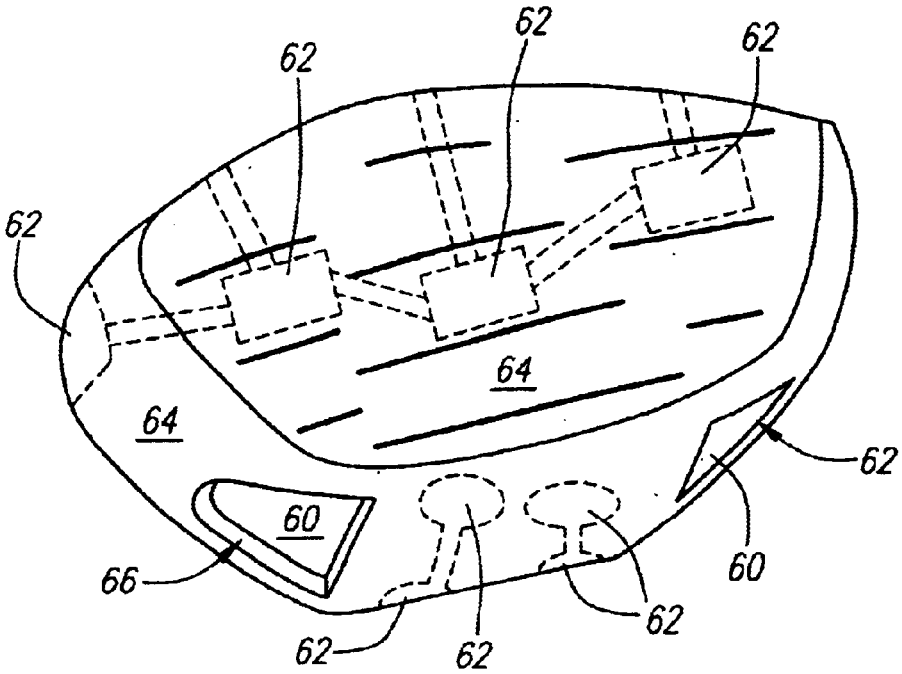
FIG. 6 is a perspective view looking up at the front of the ceramic core of FIG. 2 with wax formed over the majority of the exterior surface of the core.
Figure 7:
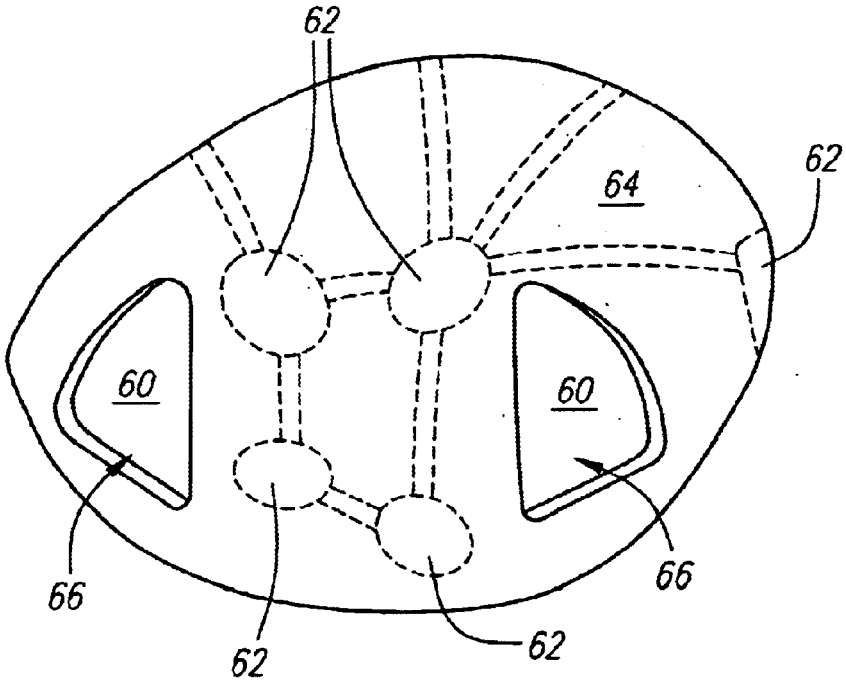
FIG. 7 is a perspective view looking down at the bottom of the ceramic core of FIG. 6.

FIGS. 6 and 7 illustrate ceramic core 44 after injection molding in second mold 18. Wax 64 is formed about exterior surface 60 of ceramic core 44, with the exception of two areas 66, which correspond to projections 42 in second mold cavity portion 24*a*. Thus, in areas 66 the exterior surface 60 of ceramic core is exposed. Wax 64 combines with wax protuberances 62, shown in phantom lines, to provide a wax covered ceramic core.

The wax covered ceramic core of FIGS. 6 and 7 is then used to manufacture the golf club head. First, a shell (not shown) is formed over the wax covered ceramic core. The wax 64 is then melted, leaving a gap (not shown) between the shell and the ceramic core. Molten metal is then cast into the gap between the shell and the ceramic core to form the golf club head. The club head is typically formed of titanium, steel, titanium alloys, steel alloys, amorphous metals and the like. The club head can vary in size from 150 cc to 500 cc, and preferably 250 cc to 385 cc, with wall thicknesses varying from 0.002 inch to 0.350 inch, preferably 0.035 inch to 0.150 inch, and more preferably 0.040 inch to 0.100 inch.

When the metal cools, the shell is removed to expose a metal golf club head with the ceramic core inside. The ceramic core may then be broken down using ultrasonic vibration and removed from metal golf club head 68. Additional information about wax molding methods and articles for manufacturing golf club heads is disclosed in U.S. Pat. Nos. 5,547,360, 5,577,550, 5,204,046, 5,669,828 and 5,417,559, all of which are hereby incorporated by reference in their entirety.

Figure 8:
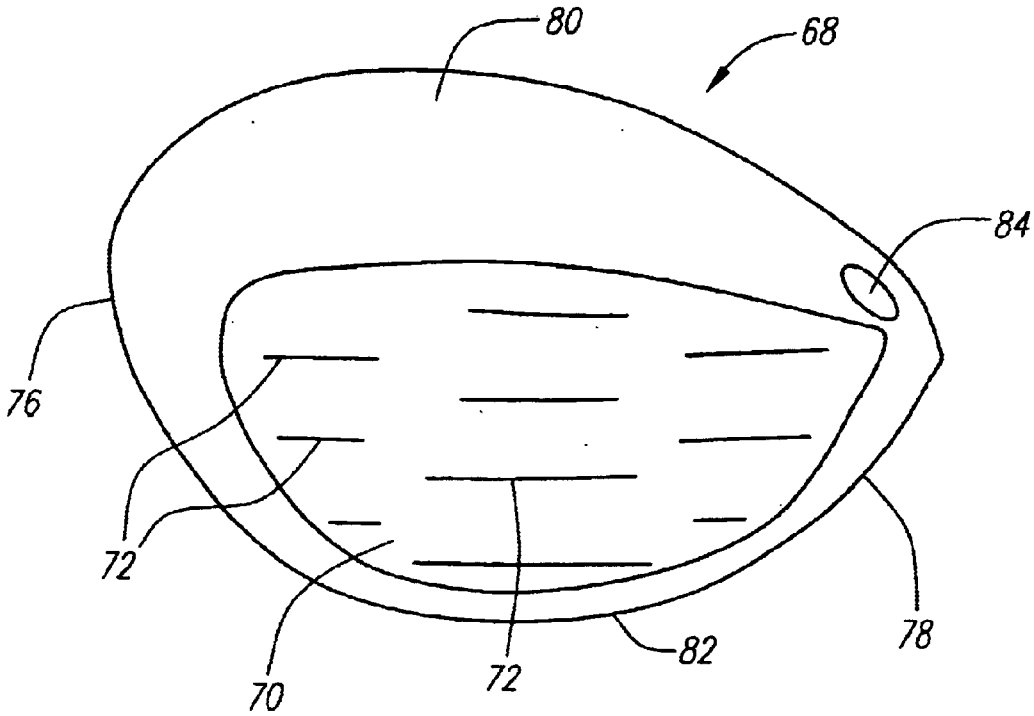
FIG. 8 is a front perspective view of a golf club head formed in accordance with the present invention.
Figure 9:
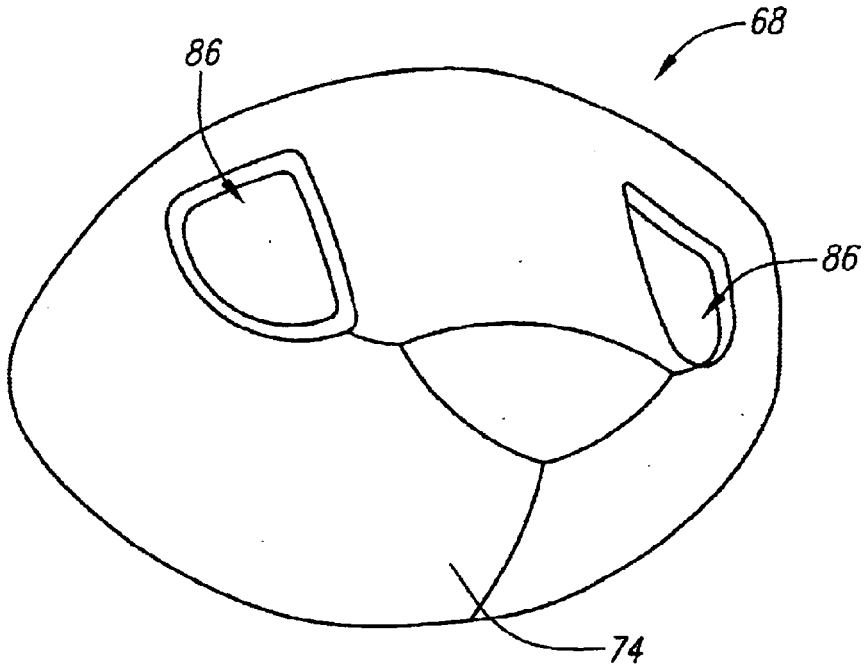
FIG. 9 is a perspective view of the bottom of the golf club head of FIG. 8.

FIGS. 8 and 9 illustrate a hollow metallic golf club head 68 manufactured in accordance with the present invention.

Club head 68 includes a front face 70 with a plurality of scorelines 72 formed thereon, a rear portion 74, a toe portion 76, a heel portion 78, a crown portion 80, and a sole portion 82. Club head 68 further includes an opening 80 heel portion 78 of crown 80 for a golf club shaft (not shown). Sole portion 82 of club head 68 further includes openings 84, through which ceramic core 44 was extracted. Each opening 84 may then be covered with a small plate or a medallion (not shown).

Hollow, metallic club head 68 is generally a one-piece club head with small openings that are covered by medallions. Because there is no large opening in either the crown or sole to accommodate the removal of an aluminum core, a large plate does not need to be welded over the opening and then sanded. The apparatus 10 and the two-step molding process ensure that the walls of club head 68 do not have any unwanted variations in thicknesses. In addition, the present invention enables complex internal shapes, such as pockets for weight injection, to be easily produced.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention, which is intended to be unlimited by the foregoing except as may appear in the following appended claims. Therefore, the embodiments of the invention in which an exclusive property or privilege is claimed are defined in the following appended claims.

What is claimed is:

1. A method for forming a hollow, metallic golf club head, the method comprising:

placing a ceramic core into a first mold cavity, the first mold cavity having a plurality of depressions formed therein;

injecting wax into the first mold cavity to fill in the plurality of depressions, the wax adhering to portions of an exterior surface of the ceramic core and forming a plurality of wax protuberances on the exterior surface, each protuberance corresponding to a respective depression in the first mold cavity;

placing the ceramic core with the wax protuberances into a second mold cavity, the second mold cavity having a shape complementary to a desired exterior of the golf club head, the plurality of wax protuberances properly positioning the ceramic core in the second mold cavity;

injecting wax into the second mold cavity, the wax adhering to a majority of the exterior surface of the ceramic core and to the wax protuberances; forming a shell over the wax;

melting the wax to form a gap between the shell and the ceramic core; and casting molten metal into the gap to form the golf club head.

2. The method according to claim 1, further comprising providing the first mold cavity with the plurality of depressions, each depression having a depth substantially equal to a desired wall thickness of a corresponding portion of the golf club head.

3. The method according to claim 2, further comprising providing the first mold cavity with a plurality of channels formed therein, the channels interconnecting the depressions.

4. The method according to claim 1, wherein placing the ceramic core into the first and second mold cavities includes fully enclosing the ceramic core within each of the first and second mold cavities.

5. The method according to claim 1, further comprising removing the ceramic core from the metal golf club head.

* * * * *